US007770326B2

(12) United States Patent
Al-Qassem

(10) Patent No.: US 7,770,326 B2
(45) Date of Patent: Aug. 10, 2010

(54) SAFETY DOOR, DOOR LOCK AND DOOR LOCK RELEASE MECHANISM

(76) Inventor: Sadeq Ahmed Al-Qassem, Block 7, Street 17, House 8, Adan (KW)

( * ) Notice: Subject to any disclaimer, the term of this patent is extended or adjusted under 35 U.S.C. 154(b) by 162 days.

(21) Appl. No.: 12/061,983

(22) Filed: Apr. 3, 2008

(65) Prior Publication Data

US 2009/0249693 A1 Oct. 8, 2009

(51) Int. Cl.
*G08B 13/08* (2006.01)

(52) U.S. Cl. ..... 49/13; 49/14; 49/31; 315/153; 340/545.1; 340/573.1; 340/666; 340/686.1; 340/686.6

(58) Field of Classification Search ..... 49/13, 49/14, 31; 315/153; 340/545.1, 825, 573.1, 340/686.1, 686.6, 666
See application file for complete search history.

(56) References Cited

U.S. PATENT DOCUMENTS 5,097,454 A * 3/1992 Schwarz et al. ..... 367/93
5,150,099 A * 9/1992 Lienau ..... 340/552
5,422,552 A * 6/1995 Parisi ..... 318/466
5,541,585 A * 7/1996 Duhame et al. ..... 340/5.62
5,565,843 A * 10/1996 Meyvis ..... 340/691.6
5,605,013 A * 2/1997 Hogston ..... 49/31
5,625,266 A * 4/1997 Stark ..... 318/466
5,992,096 A * 11/1999 De La Cerda et al. ..... 49/169
6,023,224 A * 2/2000 Meyvis ..... 340/545.1
6,049,287 A * 4/2000 Yulkowski ..... 340/693.12
6,057,764 A * 5/2000 Williams ..... 340/572.1
6,218,956 B1 * 4/2001 Davis et al. ..... 340/5.2
6,297,739 B1 * 10/2001 Small ..... 340/573.3
6,930,607 B2 * 8/2005 Kiel et al. ..... 340/573.1
6,947,578 B2 * 9/2005 Lee ..... 382/116
6,998,977 B2 * 2/2006 Gregori et al. ..... 340/505
7,005,990 B1 * 2/2006 Rocci ..... 340/573.1
7,102,508 B2 * 9/2006 Edelstein et al. ..... 340/539.13
7,272,246 B2 * 9/2007 Li et al. ..... 382/116
7,564,362 B2 * 7/2009 Cole et al. ..... 340/573.1
2004/0183677 A1 * 9/2004 Fitzgibbon ..... 340/540
2007/0130833 A1 * 6/2007 Maital ..... 49/31

* cited by examiner

*Primary Examiner*—Jerry Redman
(74) *Attorney, Agent, or Firm*—Lowe Hauptman Ham & Berner, LLP

(57) ABSTRACT

A safety door, door lock and door lock release mechanism for preventing a child from opening a door while permitting an adult to do so includes a weight sensor and a height sensor for unlocking a locked door. An alarm is used to indicate a child's attempt to open the door and a sensor for sensing a dangerous condition such as smoke or carbon monoxide is also provided for unlocking the door in the event of a dangerous condition and activating a more discernable alarm at that time.

1 Claim, 5 Drawing Sheets

FIG. 7
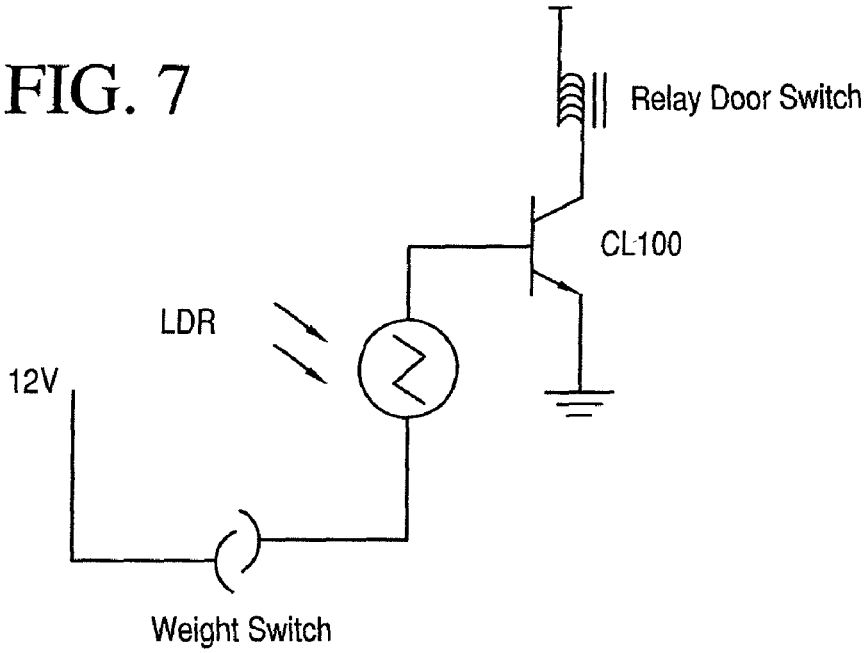
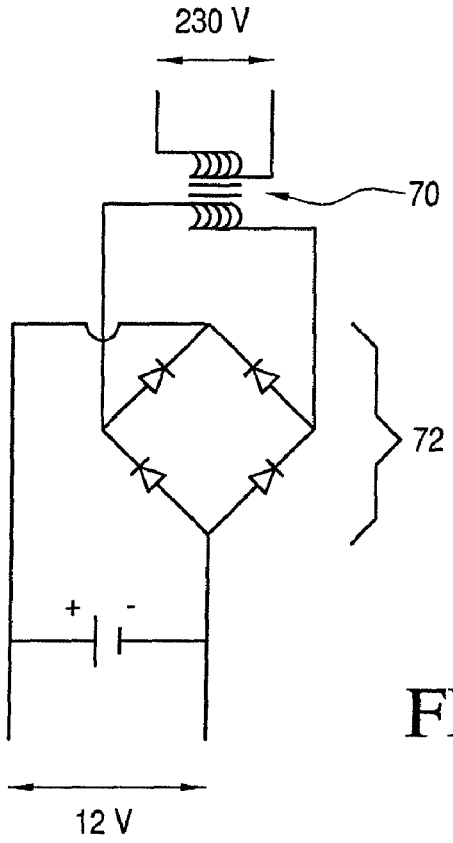
FIG. 8

SAFETY DOOR, DOOR LOCK AND DOOR LOCK RELEASE MECHANISM

FIELD OF THE INVENTION

This invention relates to a safety door, door lock and door lock release mechanism for preventing a child from opening a door while allowing an adult to do so and more particularly to a safety door, door lock and release mechanism that releases the lock in the event of a dangerous condition and sounds an alarm so that the child may open the door.

BACKGROUND FOR THE INVENTION

Allowing a young child to leave the safety of a home or other secure area without adult knowledge or supervision exposes the child to dangerous conditions. For example, the child may wonder off, become lost, hit by a car, bit by a dog or wild animal and even being kidnapped. Therefore, it is believed that there is a need for a safety door, door lock and door lock release mechanism for preventing a child from opening a door, window or the like while allowing an individual to do the same without undo interference.

Problems of a similar nature have been recognized. For example a U.S. patent of Bryll, No. 4,189,708 discloses a method and apparatus for controlling access to a facility. As disclosed, the system denies unauthorized access to a locked facility by a person having a weight characteristic differing from that of the weight characteristic of the person locking the facility. The system comprises a method and apparatus which may be selectively activated to measure a deflection caused by a person locking a facility. The system comprises a method and apparatus which may be selectively activated to measure a deflection caused by a person seated in a vehicles driver's seat. The deflection is weight information which is stored. A person subsequently seated in the vehicle seat and attempting to operate the ignition causes a second measuring operation and a comparison of the newly measured weight information with the stored information to test for a substantial parity there between. A substantial parity of these weights allows operation of the starting motor of a vehicle while a disparity between the weights operates a timer and/or alarm means while disabling the vehicle starter motor.

The system may be used to control access to various other kinds of lock facilities such as locked rooms or buildings.

A more recent patent of Parcvuescu, No. 6,081,758 discloses a system for automatically unlocking an automobile child safety door lock. As disclosed, the system includes an emergency sensor such as a collision sensor initiating airbag deployment, a door lock mechanism and a door lock releasing mechanism. Upon the sensor detecting an emergency such as a collision, the sensor produces a signal that is sent to the door lock releasing mechanism. The door lock releasing mechanism then unlocks the door. The sensor may also trigger disconnection of the battery from the automobile's electrical circuitry and interruption of the fuel line from the fuel tank to the engine. The emergency sensor may alternatively include a temperature or smoke sensor.

A further patent of Talbot, No. 6,206,452 discloses a vehicle having an automatic child lock function that is controlled by an electronic control unit. The electronic control unit receives signals from weight sensors in the base portion of each of the passenger seats. The findings from the sensors are used to determine both the occupancy of the vehicle and to produce a signal indicative of the weight of each of the passengers of the vehicle. The electronic control unit is programmed to operate such that if the signal received from a particular sensor indicates that the passenger is below a predetermined weight which indicates that the passenger is probably a child, the associated door is prevented from being opened from a closed position even when an interior door handle is operated by the passenger.

However, none of the above mentioned patents directly address the problem of a child leaving a secured area as for example a home without knowledge or supervision of an adult.

None of the patents address the problem of allowing an adult to use a door without the need to unlock a door while preventing a child from leaving through the same door. None of the patents disclose a method and system for warning an adult that a child is attempting to leave the security of the house or automatically warning a parent or supervisor of a dangerous condition and at the same time automatically releasing a door lock permitting a child to leave the house in the event of a fire or other dangerous condition.

Accordingly, it is presently believed that there is a need and a potential commercial market for a safety door, door lock and door lock release mechanism in accordance with the present invention. There should be a commercial market because such safety doors, door lock and door lock releasing mechanism prevent a child from opening the door while allowing an adult to do so.

A further advantage of the safety door, door lock and door lock release mechanism resides in the use of a weight sensor and height sensor and in one embodiment a switch for actuating the program that is disposed at a height above the reach of a child. Further, the safety door, door lock and door lock release mechanism include means for entering pre-selected weights and heights into a memory so that an individual can select the weight and height needed to actuate the release of the lock by the door lock release mechanism.

It is also believed that a system in accordance with the present invention can be manufactured and sold at a reasonable price, are reliable and durable. A still further advantage of the present invention resides in the ability to install the door lock release mechanism in a door jam adjacent to the door. This allows installation of an electrical circuit without requiring a flexible connection to allow for the opening and closing of the door. A further advantage of the present invention resides in the use of a door alarm system wherein the second alarm, which indicates a dangerous condition, provides a louder and more visual alarm.

BRIEF SUMMARY OF THE INVENTION

In essence, the present invention contemplates a safety door, door lock and door lock release mechanism for preventing a child from opening a door while allowing an adult to do so and also warning an adult that a child is attempting to open the door. The safety door, door lock and door lock mechanism also sounds an alarm and releases the lock in the event of a dangerous condition as for example, fire, smoke or carbon monoxide. The safety door, door lock and door lock mechanism includes a door having first and second sides disposed in a doorway between two areas for allowing access and/or egress from one of the two areas to a second of the two areas. A door lock prevents the door from opening while a door lock release mechanism releases the door lock so that an adult can open the door without problem.

In one embodiment of the invention a switch provided at a height above the reach of a child is added and is necessary for activating the sensors and for releasing the lock except for the release due to a dangerous condition.

The invention also contemplates a sensing mean such as a pressure pad disposed on one side of the door as for example on the inside of a structure for sensing the weight of an individual in an area adjacent to one side of the door. A second sensing means is also disposed on the same side of the door as the first sensing means and senses the height of an individual in the area adjacent to the door. Memory means such as a computer and means such as a keypad for inputting a first pre-selected weight and first pre-selected height into the memory are also provided.

Means such as a computer and program automatically release the door lock when the first sensing means senses a weight in excess of a first pre-selected and/or the second sensing means senses a height of an individual in excess of the first pre-selected height.

An important aspect of the present invention relates to an alarm and means for activating this alarm when an individual such as a child with a weight less than the first pre-selected weight and/or a height less than the first pre-selected height attempts to open the door. Another important aspect of the invention resides in means for sensing a dangerous condition as for example a conventional smoke and carbon monoxide alarm and means for releasing the lock when a dangerous condition is sensed. This means simultaneously activates an alarm to warn any inhabitant that the lock has been released and that they should check on any children and leave the structure. The alarms are typically audible but may include a visual alarm and preferably employ different characteristics.

The invention will now be described in accordance with the following figures wherein like numbers have been used to illustrate like parts.

DESCRIPTION OF THE DRAWINGS

FIG. 7 is a schematic illustration of a portion of an electrical circuit for releasing a door lock in accordance with an embodiment of the invention;

FIG. 8 is a schematic illustration of a portion of an electrical circuit for converting 230V. A.C. to 12 V D.C. for use in the invention.

DESCRIPTION OF THE PREFERRED EMBODIMENTS OF THE INVENTION

Figure 1:
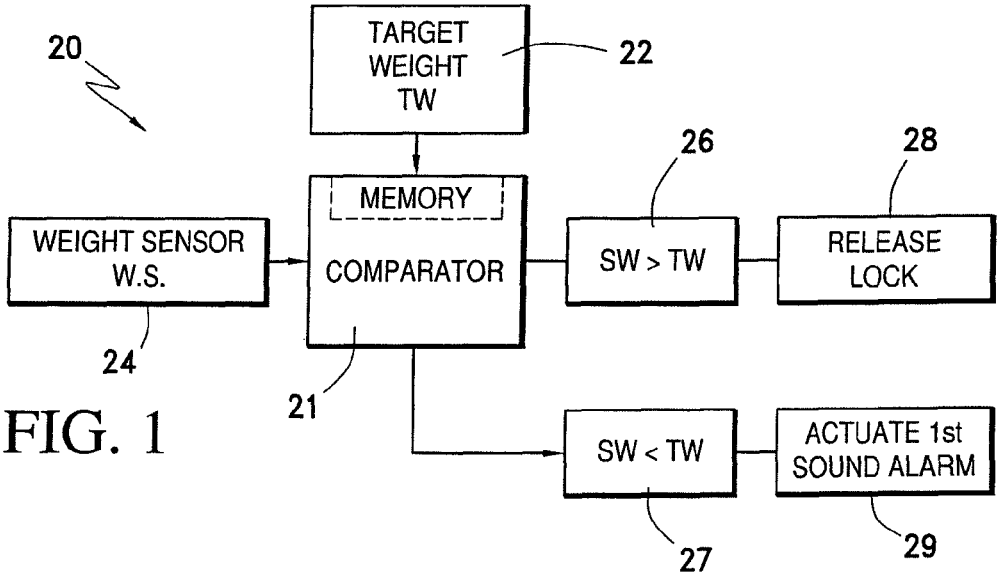
FIG. 1 is a block diagram illustrating a general concept of first portion of the invention.
Figure 2:
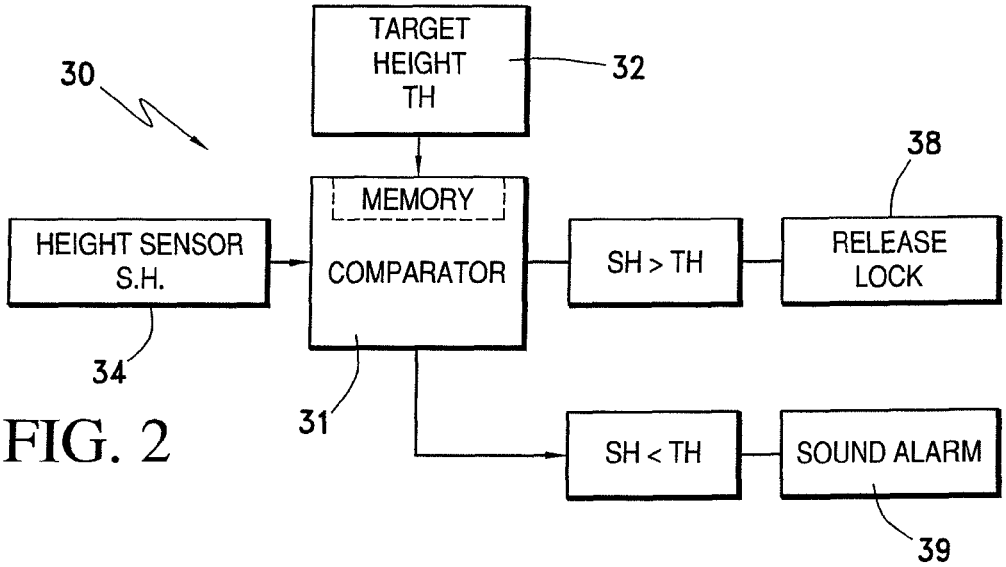
FIG. 2 is a block diagram illustrating a general concept of a second portion of the invention.
Figure 3:
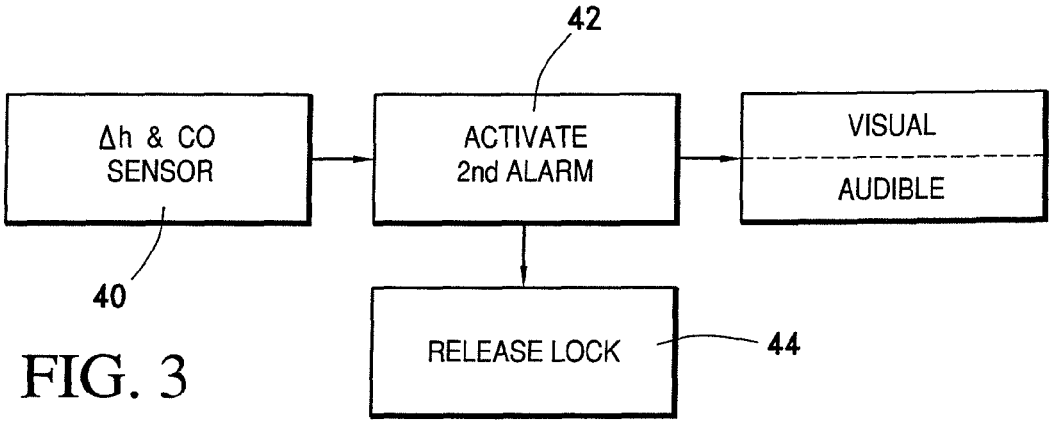
FIG. 3 is a block diagram illustrating a general concept of a third portion of the invention.

FIGS. 1-3 illustrate the key elements in a safety door, door lock and door lock release mechanism for preventing a child from opening a door to leave a confined area and obtaining access to the outside of a structure. The safety door may of course be used to prevent a child from obtaining access to a restricted area within a house as for example a storage room for household chemicals, photo-lab or the like. However, the primary purpose of the present invention is to make certain that a child does not slip outside a house without the knowledge of a parent or adult supervisor.

As illustrated in FIG. 1 a safety door, door lock and door lock release mechanism sometime referred to as a system 20 includes memory means such as a computer or comparator 21 and means 22 for entering a target weight (TW) into the memory of the comparator 21. The system 20 also includes a weight sensor 24 such as a pressure pad, electronic scale etc. When an individual steps on the weight sensor a signal indicative of the individual's weight is fed to the comparator 21. Then when the sensed weight is greater than the target weight as indicated in box 26 the lock will be released or opened as indicated in box 28. This allows an individual to pass through the door without problem. However, when the comparator 21 indicates that the sensed weight is less than the target weight as indicated by box 27 a first alarm is activated as indicated by box 29 and the lock release mechanism does not release the lock.

A second portion 30 of the safety door, door lock and door lock release mechanism is shown in FIG. 2 wherein memory means such as a computer or comparator 31 and means 32 for entering a target height (TH) into the memory of the comparator. In practice a single comparator and means for entering a target weight and target height will be used. However, for convenience they have been described a separate elements. The system 30 includes a height sensor that may comprise a photo detector and light beam to sense that an individual's height is greater that the target height when the beam is broken. Thus when the sensed height is greater that the target height as indicated by box 36, the lock is released as indicated by the box 38 so that the safety door may be opened.

It should be recognized that the system can be programmed so that it requires a sensed weight greater than a target weight and a sensed height greater than a target height to release the door lock or only one of the two parameters exceeded to open the door. The use of both parameters increases the difficulty for a child or several children to overcome the system.

FIG. 3 shows a sensor 40 for sensing a dangerous condition such as fire, smoke or carbon monoxide and in response to a dangerous condition activates an alarm 42 and at the same time releases a lock 44 allowing a child or adult to open the door and leave the building. As indicated, the alarm may be audio and visual and is preferably clearly distinguishable from a first alarm 29 or 39. For example, the alarm for a dangerous condition should be louder and perhaps accompanied by a strobe light both of which continue until reset.

Figure 4:
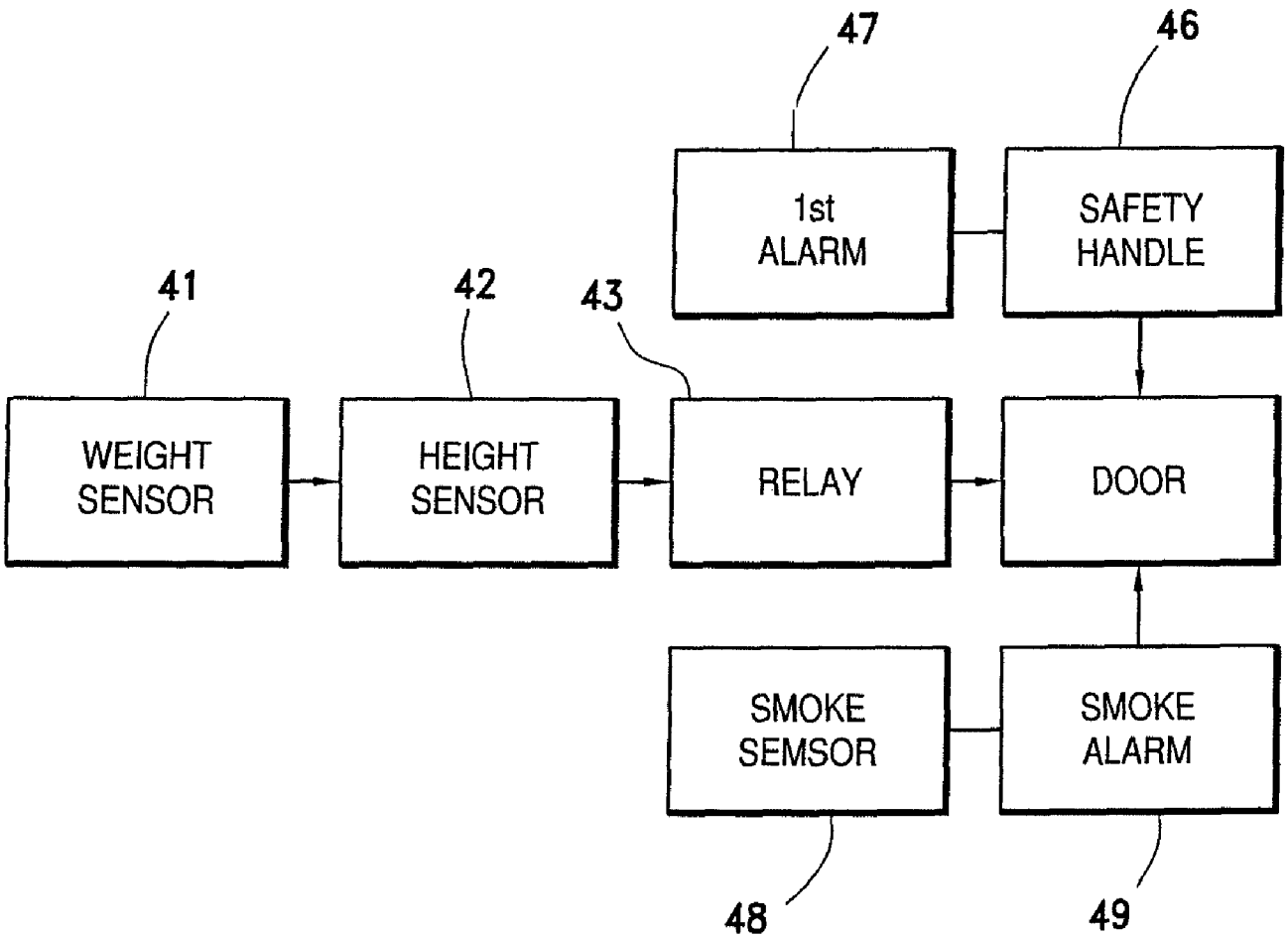
FIG. 4 is a block diagram illustrating a first embodiment of the invention.

FIG. 4 illustrates a second embodiment of the invention wherein a weight sensor 41 is programmed to activate a switch (not shown) when an individual weighs over a preselected weight of for example 30 Kg. is sensed. Similarly a height sensor 42 is constructed and arranged to sense the height of an individual standing in front of a door 44. For example, when an individual's height is 70 cm or more and their weight is in excess of 30 Kg a relay 43 is activated. The relay 43 activates the door lock release mechanism (not shown in FIG. 4) to unlock the door 44. As illustrated a safety handle 46 is configured and arranged to activate a first alarm 47 when an individual that does not meet the height and weight requirements tries to open the door. This first alarm is a relatively low level alarm but may also illuminate light that stays on until reset by an adult. In addition, when a smoke sensor 48 or the like senses a dangerous condition it activates a smoke alarm 49 which is a shrill, loud alarm that may also include a strobe light (not shown in FIG. 4).

Figure 5:
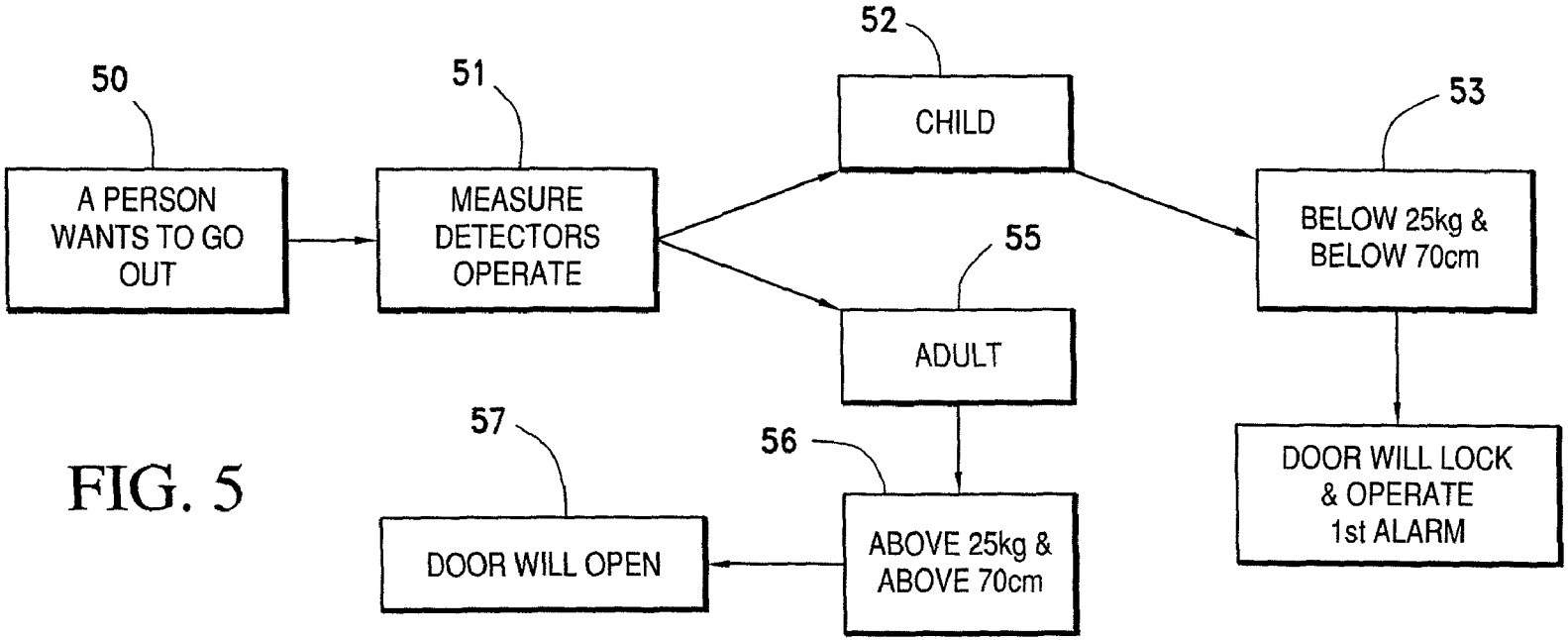
FIG. 5 is a block diagram illustrating the operation of one embodiment of the invention.

The operation of a safety door, door lock and door lock release mechanism in accordance with the present invention will now be described in connection with FIG. 5. As illustrated, when an individual decides to pass through a door as indicated by box 50, they approach the door and stand on or in the area to detect their height and weight in step 51. If the detection in step 51 indicates that the individual is a child indicated by box 52 and 53 the door will remain locked and a first alarm will be activated as for example by sound in box 54. On the other hand if the detector senses an adult as shown in box 55 i.e. above 25 Kg and/or above 70 cm as indicated by the box 56, the door will open as indicated by box 57.

Figure 6:
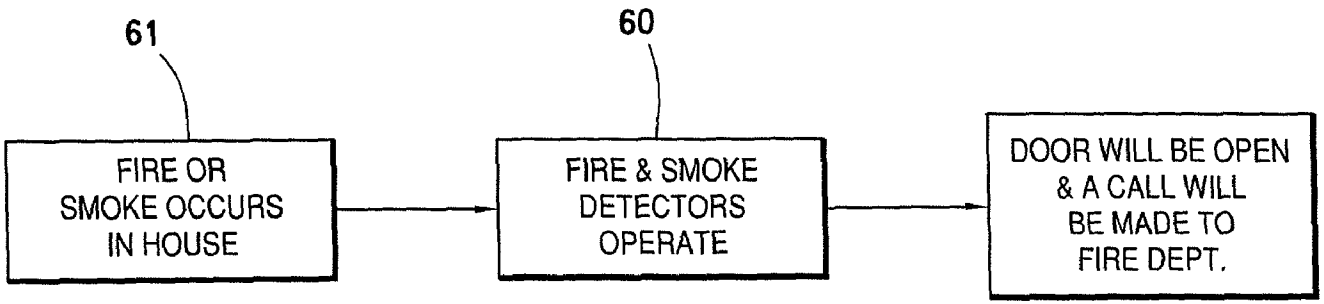
FIG. 6 is a block diagram illustrating the operation of the invention under a different scenario.

In an alternative mode, (FIG. 6) when a fire an or smoke detector 60 operates in response to sensing fire, smoke, carbon monoxide or the like occurring inside a house as indicated by 61, the door (not shown) will be unlocked and an automatic telephone call made to the nearest firehouse (not shown) as indicated at 62. In such circumstances a separate alarm may also be sounded.

FIG. 7 shows a portion of a 12V electrical circuit wherein a signal from a weight switch is fed to a light dependent resistor 62. For example, when the weight switch is closed by an individual with a weight in excess of 25 or 30 Kg and a height in excess of for example 70 cm a light dependent resistor 62 feeds a signal to an npn transistor 64. This transistor 64 may be a CL100 general purpose npn transistor that is used as an electrically controlled switch. The output of the transistor 64 then activates a relay 66 to unlock a door (not shown).

A circuit for providing a 12VDC power supply as used in one embodiment of the invention is shown in FIG. 8. As shown, a 230V to 12V step-down transformer 70 is used to reduce the voltage from 230VAC to 12VAC. Then four diodes 72 are used to convert the 12VAC to 12VDC. For the U.S. market, a 120VAC will be converted to 12VDC as will be well understood by persons of ordinary skill in the art.

Figure 9:
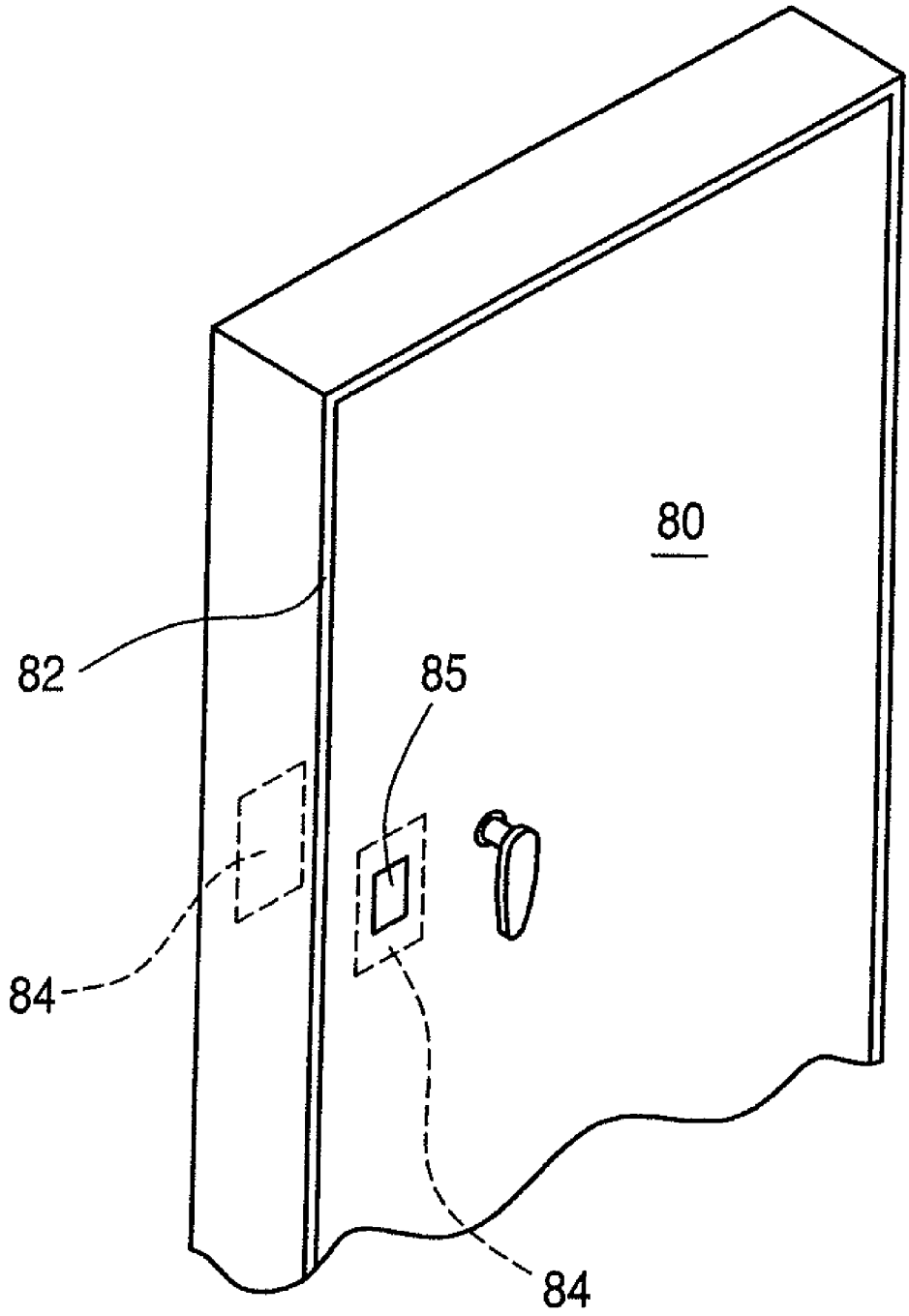
FIG. 9 is a schematic illustration of a safety door in accordance with one embodiment of the invention.

FIG. 9 illustrates a safety door that has a lock release mechanism located in the door or door jam as shown. As shown, a door 80 is configured and dimensioned to fit within a conventional frame 82 that includes a door jam adjacent to a latch assembly 85. The latch assembly 85 may include a conventional latch (not shown) and a lock release mechanism 84 that is preferably disposed in the door frame 82. However, if desired a lock release mechanism 84 could be fixed to one side of the door 80.

While the invention has been described in connection with its preferred embodiment, it should be recognized that changes and modifications may be made therein without departing from the scope of the appended claims.

What is claimed is:

1. A safety door, door lock and door lock release mechanism for preventing a child from opening the door while allowing an adult to do so, said safety door, door lock and door lock release mechanism comprising:

a doorway having a door jam and a door having first and second sides disposed in said door way between two areas for allowing access to and/or egress from one of said two areas to a second of said two areas, a door lock for preventing said door from being opened and a lock release mechanism disposed in said door jam for releasing said door lock so that said door may be freely opened;

a first sensing means including a pressure mat disposed on one side of the door for sensing the weight of an individual in an area adjacent to one of said sides of said door;

a second sensing means including a photo detector and a light emitter to sense that an individual's height is greater than a target height when a beam from said light emitter is broken and disposed on said one side of said door sensing the height of an individual in the area adjacent to said one side of said door;

memory means and means for inputting a first pre-selected weight and a first pre-selected height into said memory means;

means for automatically releasing said locking mechanism when said first sensing means senses a weight in excess of a first pre-selected weight and/or said second sensing means senses a height in excess of said first pre-selected height and wherein said door lock release means includes a 12VDC circuit energizing said lock release mechanism, a transformer and four diodes converting 230/120VAC to 12VDC and a light dependent resistor (LDR) activating the lock release mechanism;

a first alarm providing a low level audible warning and a light that stays on until reset by said adult, and means for activating said first alarm when an individual with a weight less than the first pre-selected weight or a height less than the first pre-selected height attempts to open the door; and a second alarm and means for sensing a dangerous condition including fire, smoke and carbon monoxide and means for releasing said locking mechanism when a dangerous condition is sensed and activating said second alarm to thereby indicate the dangerous condition and wherein said second alarm is a continuous alarm that is louder than said first alarm and includes a strobe light and automatically telephones the nearest fire house.

* * * * *